United States Patent [19]

Konno

[11] Patent Number: 4,844,022

[45] Date of Patent: Jul. 4, 1989

[54] VALVE OPERATING APPARATUS FOR AN INTERNAL COMBUSTION ENGINE

[75] Inventor: Tsuneo Konno, Saitama, Japan

[73] Assignee: Honda Giken Kogyo Kabushiki Kaisha, Tokyo, Japan

[21] Appl. No.: 89,973

[22] Filed: Aug. 27, 1987

[30] Foreign Application Priority Data

Aug. 27, 1986 [JP] Japan ..... 61-200956

[51] Int. Cl.[4] ..... F01L 1/08

[52] U.S. Cl. ..... 123/90.16; 123/90.17; 123/90.6; 123/198 F

[58] Field of Search ..... 123/90.16, 90.17, 90.27, 123/90.41, 90.44, 90.6, 315, 432

[56] References Cited

U.S. PATENT DOCUMENTS

| | | | |
|---|---|---|---|
| 3,168,083 | 2/1965 | Buchanan | 123/90.6 X |
| 3,298,332 | 1/1967 | Elsbett | 123/90.6 X |
| 4,327,676 | 5/1982 | McIntire et al. | 123/90.6 |
| 4,424,790 | 1/1984 | Curtil | 123/90.6 X |
| 4,448,156 | 5/1984 | Henault | 123/90.17 |
| 4,499,870 | 2/1985 | Aoyama | 123/198 F |
| 4,523,550 | 6/1985 | Matsuura | 123/90.16 |
| 4,534,323 | 8/1985 | Kato et al. | 123/90.16 |
| 4,535,732 | 8/1985 | Nakano et al. | 123/90.16 |
| 4,537,164 | 8/1985 | Ajiki et al. | 123/90.16 |
| 4,537,165 | 8/1985 | Honda et al. | 123/90.16 |
| 4,545,342 | 10/1985 | Nakano et al. | 123/198 F |
| 4,576,128 | 3/1986 | Kenichi | 123/198 F |
| 4,584,974 | 4/1986 | Aoyama et al. | 123/90.16 |
| 4,589,387 | 5/1986 | Miura et al. | 123/198 F |
| 4,612,884 | 9/1986 | Ajiki et al. | 123/90.16 |
| 4,656,977 | 4/1987 | Nagahiro et al. | 123/90.16 |
| 4,690,110 | 9/1987 | Nishimura et al. | 123/90.17 |

FOREIGN PATENT DOCUMENTS

| | | |
|---|---|---|
| 0186341 | 7/1986 | European Pat. Off. . |
| 0213758 | 3/1987 | European Pat. Off. . |
| 3613945 | 10/1986 | Fed. Rep. of Germany . |
| 1003568 | 3/1952 | France . |
| 6119911 | 7/1984 | Japan . |
| 61-81510 | 4/1986 | Japan . |
| 2141172 | 12/1984 | United Kingdom . |

*Primary Examiner*—Willis R. Wolfe
*Attorney, Agent, or Firm*—Lyon & Lyon

[57] ABSTRACT

Valve operating apparatus for an internal combustion engine in which plural intake valves and exhaust valves are associated with each cylinder. The respective valves are operated in one engine-operating condition in response to the action of a first set of cams and in another engine-operating condition in response to the action of a second set of cams coupled to the first cam set. The cams operating the intake valves impart a different valve operating action than those operating the exhaust valves.

12 Claims, 6 Drawing Sheets

VALVE OPERATING APPARATUS FOR AN INTERNAL COMBUSTION ENGINE

BACKGROUND OF THE INVENTION

The present invention relates to a valve operating apparatus for an internal combustion engine. More particularly, the invention involves valve operating apparatus capable of changing the modes of operation of both the intake valves and the exhaust valves associated with the cylinder of an internal combustion engine according to varying operating conditions of the engine.

Japanese Laid-Open Patent Publication Nos. 59-226216 and 61-19911 are directed to valve operating mechanisms of the described type. These mechanisms are designed such that the intake valves and the exhaust valves have substantially the same operating modes. Since exhaust gas emitted from an engine has a high temperature and flows at a high velocity, it is desirable that, under certain conditions, the exhaust valve have a cross-sectional area of valve opening which is smaller than that of the intake valve. Where the above prior art valve operating mechanisms are designed to operate the intake and exhaust valves in accordance with substantially the same operation modes it is impossible to operate the respective valves to accommodate changing the exhaust valve opening appropriately under these certain conditions.

It is to the amelioration of this problem, therefore, that the present invention is directed.

SUMMARY OF THE INVENTION

According to the present invention, the intake and exhaust valve operating mechanisms are arranged such that the operation modes of the intake and the exhaust valves operated thereby can be different from each other. Since the respective intake and exhaust valves can be made to operate in different modes of operation they can each be accurately operated in such different modes of operation.

It is, therefore, an object of the invention to provide a valve operating apparatus for an internal combustion engine capable of opening and closing the respective intake and exhaust valves accurately in their respective operation modes.

For a better understanding of the invention, its operating advantages and the specific objectives obtained by its use, reference should be made to the accompanying drawings and description which relate to a preferred embodiment thereof.

DESCRIPTION OF THE PREFERRED EMBODIMENTS OF THE INVENTION

Figure 1:
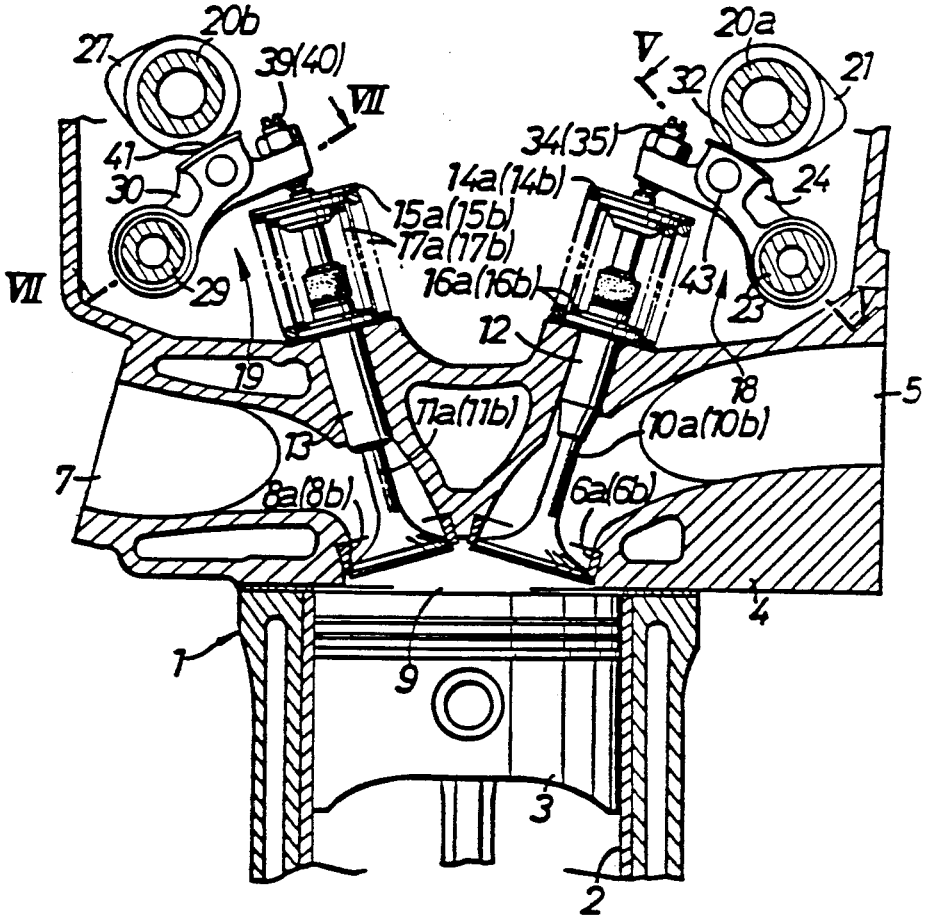
FIG. 1 is a sectional elevational view of an internal combustion engine incorporating the present invention.

In FIG. 1, which shows a first embodiment of the present invention, a piston 3 is reciprocally movable in the cylinder 2 of an engine body 1. A cylinder head 4, which covers the cylinder 2, has a pair of intake holes 6*a*, 6*b* provided adjacent to each other and communicating with intake ports 5. The cylinder head 4 also contains a pair of exhaust holes 8*a*, 8*b* provided adjacent to each other and communicating with exhaust ports 7. Both the intake holes 6*a*, 6*b* and the exhaust holes 8*a*, 8*b* open into a combustion chamber 9. Intake valves 10*a*, 10*b* are openably and closably disposed in the respective intake holes 6*a*, 6*b* and exhaust valves 11*a*, 1*b* are similarly disposed in the respective exhaust holes 8*a*, 8*b*. The intake valves 10*a*, 10*b* are movably inserted through a pair of guide sleeves 12 extending vertically through the cylinder head 4, and the exhaust valves 11*a*, 11*b* are similarly movably inserted through a pair of guide sleeves 13 extending vertically through the cylinder head 4. Retainers 14*a*, 14*b*, and 15*a*, 15*b* are mounted on the upper ends of the intake valves 10*a*, 10*b* and the exhaust valves 11*a*, 11*b*, respectively. The intake valves 10*a*, 10*b* and the exhaust valves 11*a*, 11*b* are normally urged to close the intake holes 6*a*, 6*b* and the exhaust holes 8*a*, 8*b*, respectively, under the bias of valve springs 16*a*, 16*b* and 17*a*, 17*b* interposed between the respective retainers 14*a*, 14*b* and 15*a*, 15*b* and the cylinder head 4. The intake valves 10*a*, 10*b* are openably and closably driven by the respective intake and exhaust valve operating mechanisms 18 and 19 disposed above the cylinder head 4.

Figure 2:
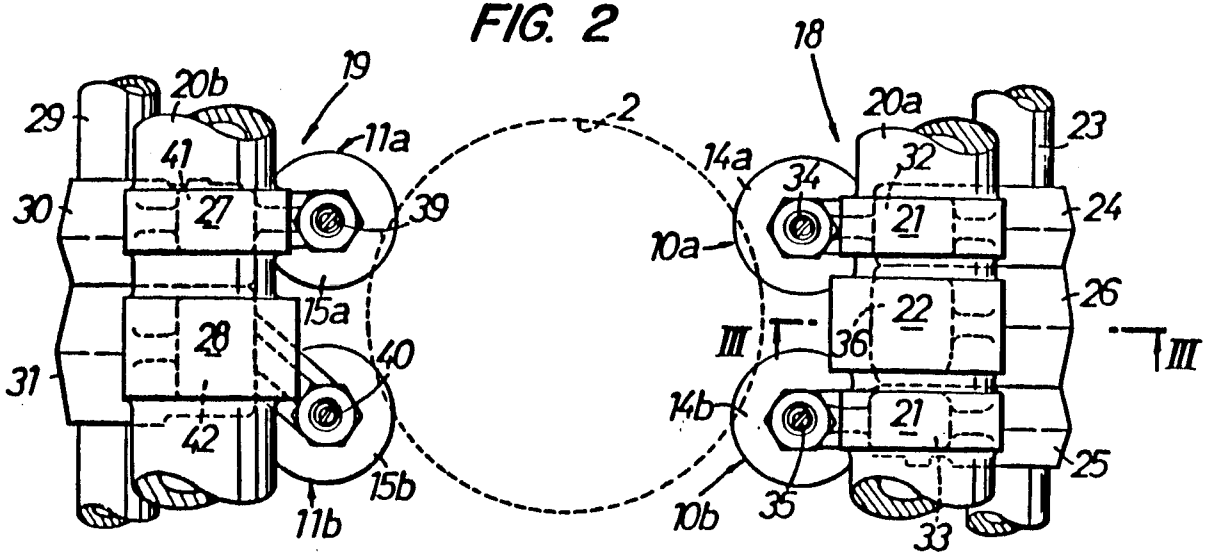
FIG. 2 is a partial plan view of the internal combustion engine of FIG. 1.

As shown in FIG. 2, the intake valve operating mechanism 18 has a pair of low-speed cams 21 and a high-speed cam 22, each of which are integrally formed on a camshaft 20*a*. The camshaft 20*a* is rotatable in synchronism with the rotation of the engine, desirably at a speed ratio of ½ with respect to the speed of rotation of the engine. First, second, and third intake rocker arms 24, 25, 26 are pivotally supported as intake cam followers on a rocker shaft 23 parallel to the camshaft 20*a*.

The exhaust valve operating mechanism 19 has a low-speed cam 27 and a high-speed cam 28 which are integrally formed on a camshaft 20*b*. The camshaft 20*b* is similarly rotatable in synchronism with rotation of the engine at a speed ratio of ½ with respect to the speed of rotation of the engine. First and second exhaust rocker arms 30, 31 are pivotally supported as exhaust cam followers on a rocker shaft 29 parallel to the camshaft 20*b*.

In the intake valve operating mechanism 18, the camshaft 20*a* is rotatably disposed above the cylinder head 4. The low-speed cams 21 which operate the intake valves 10*a*, 10*b*, are integrally formed on the camshaft 20*a*. The high-speed cam 22, which is also integrally formed on the camshaft 20*a*, is located between the respective low-speed cams 21.

The rocker shaft 23 is fixed below, and extends parallel to, the camshaft 20*a*. The first, second, and third intake rocker arms 24, 25, 26 are pivotally supported on the rocker shaft 23. The first and second intake rocker arms 24, 25 have base portions swingably supported on the rocker shaft 23 and extend to positions above the intake valves 10*a*, 10*b*. The first and second intake rocker arms 24, 25 have on their upper portions cam slippers 32, 33 held in sliding contact with the respective low-speed cams 21. Tappet screws 34, 35 are threaded through the ends of the first and second intake rocker arms 24, 25 above the intake valves 10*a*, 10*b* and are engageable with the upper ends of the intake valves 10*a*, 10*b*. The intake valves 10*a*, 10*b* are thereby operatively coupled to the first and second intake rocker arms 24, 25, respectively, by the tappet screws 34, 35.

Figure 3:
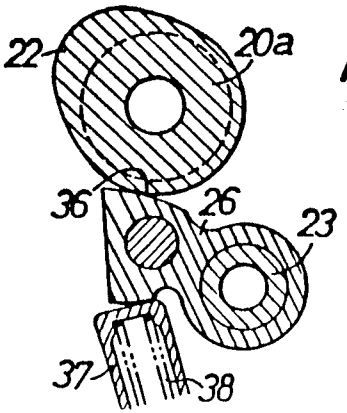
FIG. 3 is a sectional view taken along line III—III of FIG. 2.

As also shown in FIG. 3, the third intake rocker arm 26 is pivotally supported on the rocker shaft 23 between the first and second intake rocker arms 24, 25. The third intake rocker arm 26 extends slightly from the rocker shaft 23 toward the intake valves 10*a*, 10*b*, and has on its upper portion a cam slipper 36 held in sliding contact with the high-speed cam 22. A hollow cylindrical lifter 37 has its closed end held against the lower surface of the end of the third intake rocker arm 26. The lifter 37 is normally urged to move upwardly by a lifter spring 38 interposed between the cylinder head 4 and the lifter 37. The cam slipper 36 of the third intake rocker arm 26 is thus held in sliding contact with the high-speed cam 22 at all times by the spring-biased lifter 37.

In the exhaust valve operating mechanism 19, the camshaft 20*b* is rotatably disposed above the cylinder head 4 and extends parallel to the camshaft 20*a*. The low-speed cam 27 is integrally formed on the camshaft 20*b* in a position to operate the exhaust valve 11*a*, and the high-speed cam 28 is integrally formed on the camshaft 20*b* in a position to operate the exhaust valve 11*b*.

The low-speed cam 27 of the exhaust valve operating mechanism 19 is of a different cam profile than that of the low-speed cams 21 of the intake valve operating mechanism 18. The low-speed cams 21 of the intake valve operating mechanism 18 have a valve operating profile as indicated by curve A in FIG. 4, whereas the low-speed cam 27 of the exhaust valve operating mechanism 19 has a valve operating profile as indicated by curve B. Similarly, the high-speed cam 28 of the exhaust valve operating mechanism 19 is of a different cam profile than that of the high-speed cams 22 of the intake valve operating mechanism 18. The high-speed cams 22 have a valve operating profile as indicated by curve C in FIG. 4, whereas the high-speed cam 28 has a valve operating profile as indicated by curve D therein.

The rocker shaft 29 over the exhaust valves 11*a*, 11*b* is positioned below and extends parallel to the camshaft 20*b*. The first exhaust rocker arm 30 is pivotally supported on the rocker shaft 29 in a position to operate the exhaust valve 11*a*, whereas the second exhaust rocker arm 31 is pivotally supported on the rocker shaft 29 in a position to operate the exhaust valve 11*b*. The exhaust rocker arms 30, 31 extend to positions overlying the exhaust valves 11*a*, 11*b* respectively. Tappet screws 39, 40 are threaded through the ends of the exhaust rocker arms 30, 31 and are engageable with the upper ends of the respective exhaust valves 11*a*, 11*b* so that the exhaust valves 11*a*, 11*b* are operatively coupled to the respective exhaust rocker arms 30, 31. The exhaust rocker arms 30, 31 have on their upper portions cam slippers 41, 42 held in sliding contact with the respective low- and high-speed cams 27, 28.

Figure 5:
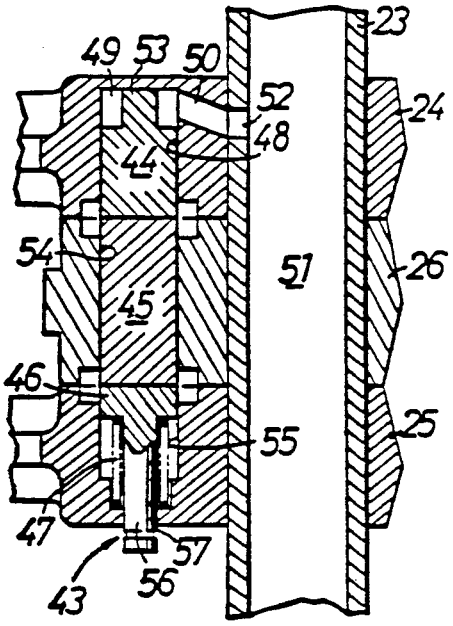
FIG. 5 is an enlarged sectional view taken along line V—V of FIG. 1 illustrating an intake valve operating mechanism in its disconnected state.

As illustrated in FIG. 5, the first, second and third intake rocker arms 24, 25 and 26 of the intake valve operating mechanism 18 have their lateral sides held in mutually sliding contact and a selective coupling 43 is disposed beween the rocker arms 24 through 26.

The selective coupling 43 comprises a first coupling pin 44 capable of connecting the first and third intake rocker arms 24, 26 and a second coupling pin 45 capable of connecting the third and second intake rocker arms 26, 25. The second coupling pin 45 is held coaxially against the first coupling pin 44. Also provided is a stopper 46 for limiting the movement of the first and second coupling pins 44, 45, and a spring 47 for urging the coupling pins 44, 45 to disconnect the rocker arms from each other.

The first intake rocker arm 24 has a first guide hole 48 extending parallel to the rocker shaft 23. The hole 48 is closed at one end and has its other end opening toward the third intake rocker arm 26. The first coupling pin 44 is slidably fitted in the first guide hole 48. The closed end of the first guide hole 48 and the adjacent end of the first coupling pin 44 cooperate to define a hydraulic pressure chamber 49 therebetween. The first intake rocker arm 24 has a hydraulic passage 50 communicating with the hydraulic pressure chamber 49. The rocker shaft 23 has a hydraulic passage 51 extending axially therethrough and communicating with a hydraulic pressure source (not shown). The hydraulic passages 50, 51 are held in communication with each other at all times irrespective of the extent to which the first intake rocker arm 24 is angularly moved, through a hole 52 defined in the side wall of the rocker shaft 23

The first coupling pin 44 has a projection extending from one end thereof, which is engageable with the closed end of the first guide hole 48. The first coupling pin 44 is provided with an axial length such that, when the abutting projection 53 abuts against the closed end of the first guide hole 48, the opposite end of the first coupling pin 44 is positioned at the interface between the first and third intake rocker arms 24, 26.

The guide hole 54 defined in the third intake rocker arm 26 extends parallel to the rocker shaft 23 and opens at the opposite sides of the third intake rocker arm 26. The guide hole 54 is thus capable of registry with the first guide hole 48. The second coupling pin 45 is slidably fitted in the guide hole 54, and has a length equal to the length of the guide hole 54. The outside diameter of the second coupling pin 45 is the same as the outside diameter of the first coupling pin 44.

The second intake rocker arm 25 contains a second guide hole 55 having one end closed and its other end opening toward the third intake rocker arm 26, such that it is capable of registry with the guide hole 54. A generally cylindrical stopper 46, which is of the same outside diameter as that of the second coupling pin 45, is slidably fitted in the second guide hole 55. A shaft 56 is coaxially joined to the stopper 46. The second intake rocker arm 25 has a guide hole 57 defined coaxially through the closed end of the second guide hole 55 to receive the shaft 56 for sliding movement therethrough.

A coil spring 47 is disposed around the shaft 56 between the stopper 46 and the closed end of the second guide hole 55. The stopper 46 and the first and second coupling pins 44, 45 are thus resiliently urged toward the closed end of the guide hole 48 in the first intake rocker arm 24 under the bias of the spring 47.

When no hydraulic pressure is applied to the hydraulic pressure chamber 49, the abutting projection 53 on the first coupling pin 44 is held in abutment against the closed end of the first guide hole 48 by the spring 47. In this condition, the abutting surfaces of the first and second coupling pins 44, 45 are located at the interface between the first and third intake rocker arms 24, 26, and the abutting surfaces of the second coupling pin 45 and the stopper 46 are located at the interface between the third and second intake rocker arms 26, 25. Therefore, the first and third intake rocker arms 24, 26 are relatively angularly movable while holding the facing ends of the first and second coupling pins 44, 45 in sliding contact with each other. The third and second intake rocker arms 26, 25 are similarly relatively angularly movable while holding the facing end of the second coupling pin 45 and of the stopper 46 in sliding contact with each other. With the selective coupling 43 thus in its disconnected state, the first and second intake rocker arms 24, 25 are angularly moved by the low-speed cams 21, whereas the third intake rocker arm 26 is angularly moved by the high-speed cam 22.

Figure 6:
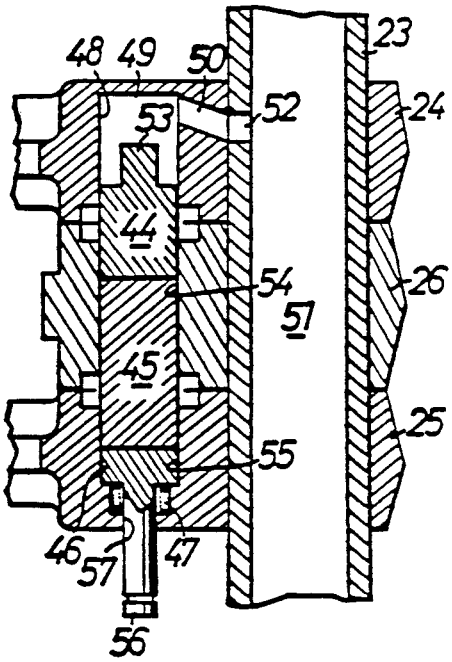
FIG. 6 is a view similar to FIG. 5 illustrating the intake valve operating mechanism in its interconnected state.

When the passage 51 and, concomitantly, the hydraulic pressure chamber 49 is supplied with hydraulic pressure, the first coupling pin 44 pushes the second coupling pin 45 and the stopper 46 against the resiliency of the spring 47, thereby forcing a portion of the first coupling pin 44 to extend into the guide hole 54 and a portion of the second coupling pin 45 to extend into the second guide hole 55, as shown in FIG. 6. With the pins disposed in this position, the first through third intake rocker arms 24 through 26 are prevented from swinging relative to each other, but, instead, are caused to swing in unison. Since the amount of angular movement of the third intake rocker arm 26 held in sliding contact with the high-speed cam 22 is greatest, the first and second intake rocker arms 24, 25 swing with the third intake rocker arm 26 according to the cam profile of the high-speed cam 22.

Figure 7:
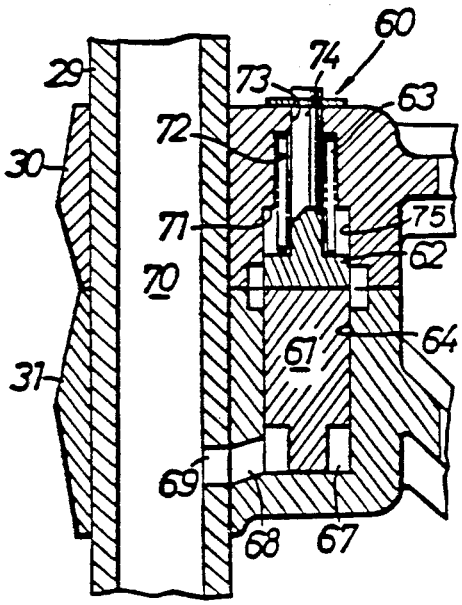
FIG. 7 is an enlarged sectional view taken along line VII—VII of FIG. 1 illustrating the exhaust valve operating mechanism.

As shown in FIG. 7, the lateral sides of the first and second exhaust rocker arms 30, 31 of the exhaust valve operating mechanism 19 are held in mutually sliding contact, and a selective coupling 60 is disposed between them. The selective coupling 60 comprises a coupling pin 61 movable between a position in which it interconnects the first and second exhaust rocker arms 30, 31 and a position in which it disconnects them from each other. Stopper 62 is operative to limit the movement of the coupling pin 51, and a spring 63 is operative for urging the stopper 62 to move the coupling pin 61 toward the position to disconnect the exhaust rocker arms 30, 31 from each other.

The second exhaust rocker ar 31 has a guide hole 64 extending parallel to the rocker shaft 29. The hole 64 is closed at one end and has its other end opening toward the first exhaust rocker arm 30. The coupling pin 61 is slidably fitted in the guide hole 64. The closed end of the guide hole 64 and the coupling pin 61 cooperate to define a hydraulic pressure chamber 67 therebetween. The second exhaust rocker arm 31 has a hydraulic passage 68 communicating with the hydraulic pressure chamber 67. The rocker shaft 29 has a hydraulic passage 70 held in communication with the hydraulic passage 68 at all times through a hole 69 defined in a side wall of the rocker shaft 29.

The coupling pin 61 has an axial length selected such that, when one end thereof abuts against the closed end of the guide hole 64, the opposite end is positioned at the interface between the first and second exhaust rocker arms 30, 31.

A guide hole 75 is defined in the first exhaust rocker arm 30 and opens toward the second exhaust rocker arm 31. The guide hole 75 has the same diameter as that of the guide hole 64 and is capable of registry with the guide hole 64. The circular stopper 62 is slidably fitted in the guide hole 75. The first exhaust rocker arm 30 has a smaller-diameter hole 72 communicating with the guide hole 70 with a step 71 therebetween. A still smaller-diameter guide hole 73 coaxial with the hole 72 penetrates the closed end of the first exhaust rocker arm 30. A shaft 74 is coaxailly joined to the stopper 72 and is movable through the guide hole 73.

The coil spring 63 is concentrically disposed around the shaft 74 between the facing surface of the stopper 62 and that of the closed end of the hole 72. The stopper 62 and the coupling pin 61 are thus urged toward the closed end of the guide hole 64 in the rocker arm 31 under the bias of the spring 63.

When no hydraulic pressure is applied to the hydraulic pressure chamber 67, the coupling pin 61 is held in abutment against the closed end of the guide hole 64 by the spring 63. In this condition, the abutting surfaces of the coupling pin 61 and the stopper 62 are located at the interface between the first and second exhaust rocker arms 30, 31. Therefore, the first and second exhaust rocker arms 30, 31 are relatively angularly movable, while the abutting surfaces of the coupling pin 61 and the stopper 62 are held in sliding contact with each other. The first exhaust rocker arm 30 is thus angularly moved by the low-speed cam 27, whereas the second exhaust rocker arm 31 is angularly moved by the high-speed cam 28.

When the hydraulic pressure chamber 67 is supplied with hydraulic pressure, the coupling pin 61 is caused to push the stopper 62 against the resiliency of the spring 63 to thereby force a portion of the coupling pin 61 into the guide hole 70. In this position, the first and second exhaust rocker arms 30, 31 are prevented from swinging with respect to each other, but instead, are caused to swing in unison. Since the amount of angular movement of the second exhaust rocker arm 31 held in sliding contact with the high-speed cam 28 is greater, the first exhaust rocker arm 30 is caused to swing with the second exhaust rocker arm 31 according to the cam profile of the high-speed cam 28.

The operation of the above-described arrangement is as follows. During low-speed operation of the engine, no hydraulic pressure is supplied to the hydraulic pressure chambers 49, 67 of the selective couplings 43, 60. At this time, the selective couplings 43, 60 are in their disconnecting position, so that the first through third intake rocker arms, 24, 25 and 26, are all relatively angularly movable. The first and second exhaust rocker arms 30, 31 are also relatively anglarly movable. Therefore, the intake valves 10*a*, 10*b* are opened and closed according to the valve operating profile shown by curve A in FIG. 4 and dependent on the cam profile of the low-speed cams 21. The exhaust valve 11*a*, on the other hand, is opened and closed according to the valve operating profile shown by curve B in FIG. 4 and the exhaust valve 11*b* is opened and closed according to the valve operating profile shown by curve D in FIG. 4.

During high-speed operation of the engine, hydraulic pressure is supplied to the hydraulic pressure chambers 49, 67 of the selective couplings 43, 60. Thus, the selective couplings 43, 60 are in their respective connecting positions, so that the first through third intake rocker arms, 24, 25 and 26, are angularly moved in unison and the first and second exhaust rocker arms 30, 31 are also angularly moved in unison. Therefore, the intake valves 10*a*, 10*b* are opened and closed according to the valve operating profile shown by curve C in FIG. 4 and the exhaust valves 11*a*, 11*b* are opened and closed according to the valve operating profile shown by curve D in FIG. 4.

From the above it will be appreciated that the operation modes of the intake valves 10*a*, 10*b* and the exhaust valves 11*a*, 11*b*, i.e., the opening and closing timings and the amounts of lift thereof, are made different from each other when the engine is in either low-speed or high-speed operation. In the exhaust valve operating mechanism 19, the exhaust valves 11*a*, 11*b* engage the two exhaust rocker arms 30, 31, such that no lifter such as that indicated as 37 is required. Accordingly, the exhaust valve operating mechanism 19 is reduced in weight and cost.

Figure 4:
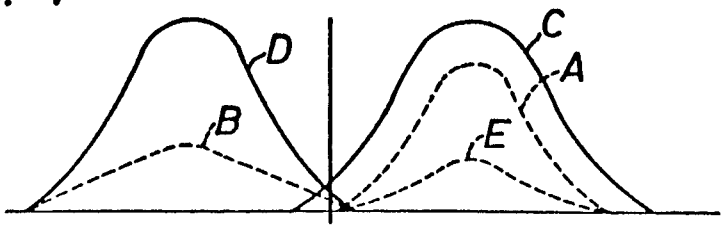
FIG. 4 is a diagram illustrating various valve operating profiles.

As a modification of the above-described embodiment of the invention, either one of the low-speed cams 21 in the intake valve operating mechanism 18 may be of such a shape as to provide a valve operating profile as indicated by curve E in FIG. 4 whereby the associated valve is caused to open only slightly.

Figure 8:
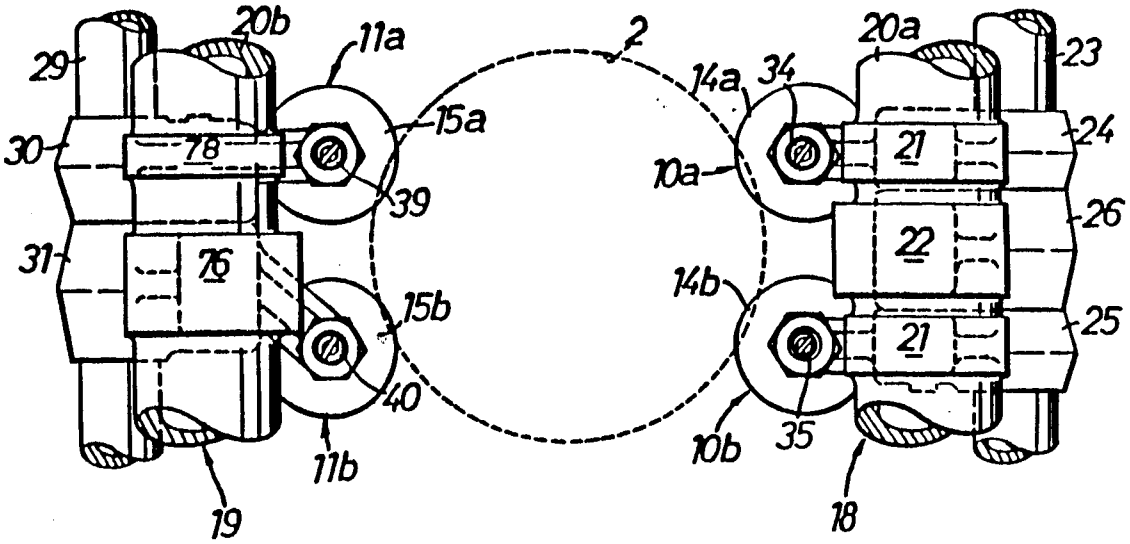
FIG. 8 is a partial plan view similar to FIG. 2 illustrating a second embodiment of the present invention.

FIG. 8 shows a second embodiment of the present invention in which parts that correspond to those of the first embodment are denoted by identical reference characters. In this embodiment the exhaust valve operating mechanism 19 has a circular raised portion 78 disposed on the camshaft 20*b* corresponding to the first exhaust rocker arm 30, and a cam 76 disposed on the camshaft 20*b* corresponding to the second exhaust rocker arm 31. The cam 76 is of a cam profile different from that of the cams 21, 22 of the intake valve operating mechanism.

In this second embodiment, during low-speed operation of the engine, the first exhaust rocker arm 30 is held in sliding contact with the circular raised portion 78 and hence is not angularly moved, thereby keeping the exhaust valve 11*a* closed. The second exhaust rocker arm 31, on the other hand, is angularly moved by the cam 76, thereby enabling the other exhaust valve 11*b* to be opened and closed at the timing and lift dictated by the profile of the cam 76. During high-speed operation of the engine, by actuation of the exhaust valve operating mechanism 19, both exhaust rocker arms 30, 31 are angularly moved by the cam 76, thereby enabling both exhaust valves 11*a*, 11*b* to be opened and closed at the timing and lift according to the profile of the cam 76.

With the exhaust valve 11*a* remaining closed during low-speed operation of the engine, any friction produced by the valve operation during low-speed engine operation can be reduced. Moreover, in a resonant rotation range (2,000 rpm to 3,000 rpm) of a timing belt (not shown) for driving the camshaft 20*b*, the maximum load on the timing belt can be reduced by keeping the exhaust valve 11*a* closed, so that the width of the timing belt can be reduced or the safety factor thereof increased.

When the exhaust valve 11*a* remains closed during low-speed operation, the valve 11*a* may stick to its valve seat, or the load on the camshaft 20*b* may vary to a large extent upon starting the valve 11*a* from the closed position. To avoid these problems, the circular raised portion 78 may be replaced with an ultra-low-speed cam which only slightly opens the exhaust valve 11*a*. With this arrangement, the problems of valve sticking and increased load change can be eliminated while substantially keeping the advantages arising from continuously closing the exhaust valve 11*a*.

Figure 9:
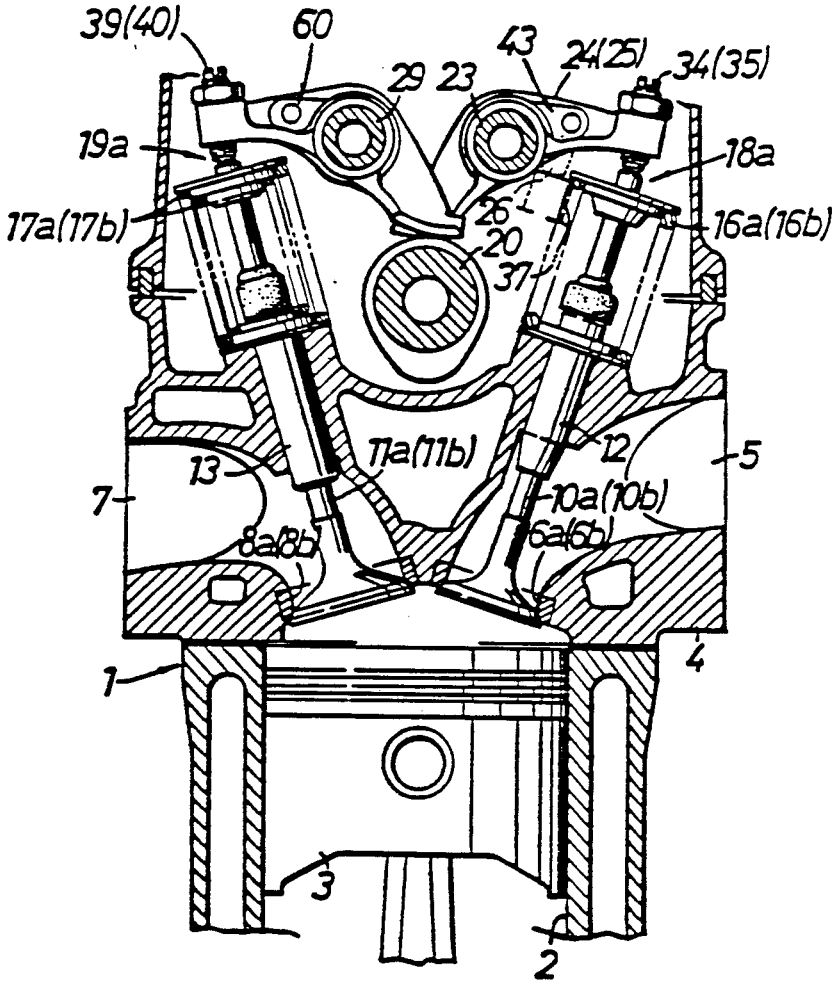
FIG. 9 is a is a sectional elevational view illustrating a third embodiment of the present invention.
Figure 10:
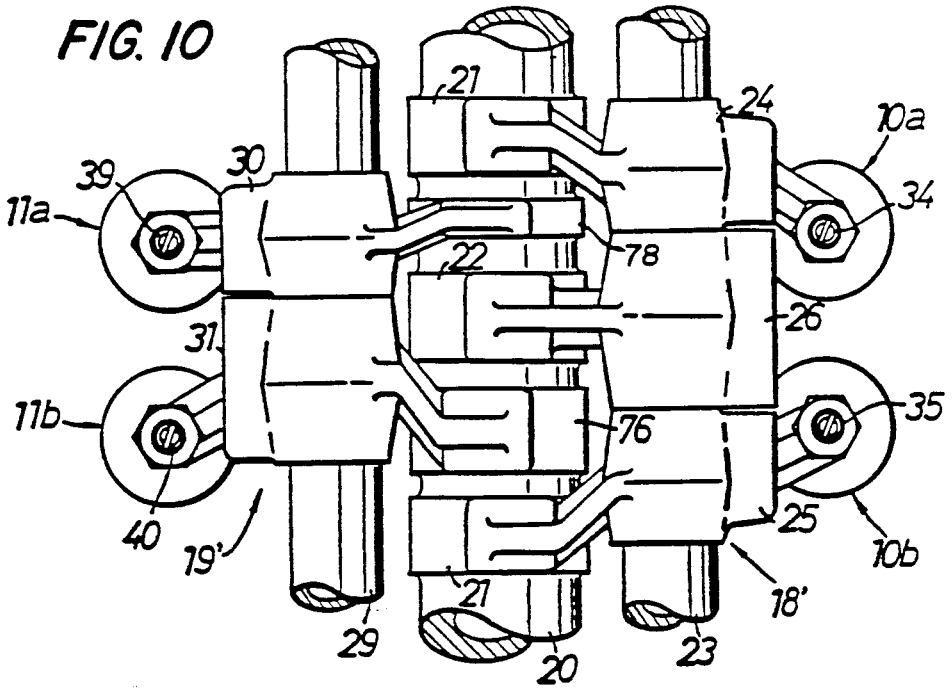
FIG. 10 is a partial plan view of the embodiment of FIG. 9.

FIGS. 9 and 10 illustrate a third embodiment of the present invention in which parts that correspond to those of the previous embodiments are designated by identical reference characters. According to this embodiment, a single camshaft 20, such as is characteristic of single overhead cam internal combustion engines, is shared by intake and exhaust valve operating mechanisms 18*a*, 19*a*, and is rotatably disposed between the rocker shafts 23, 29. The camshaft 20 has low-speed cams 21 held in sliding contact with first and second intake rocker arms 24, 25 and a high-speed cam 22 held in sliding contact with a third intake rocker arm 26. A circular raised portion 78 is held in sliding contact with a first exhaust rocker arm 30 and a cam 76 held in sliding contact with a second exhaust rocker arm 31. The first through third intake rocker arms, 24 though 26, have a selective coupling which is of the same structure as that of the selective coupling 43 described above, and the first and second exhaust rocker arms 30, 31 have a selective coupling which is of the same structure as that of the selective coupling 50 described above.

Figure 11:
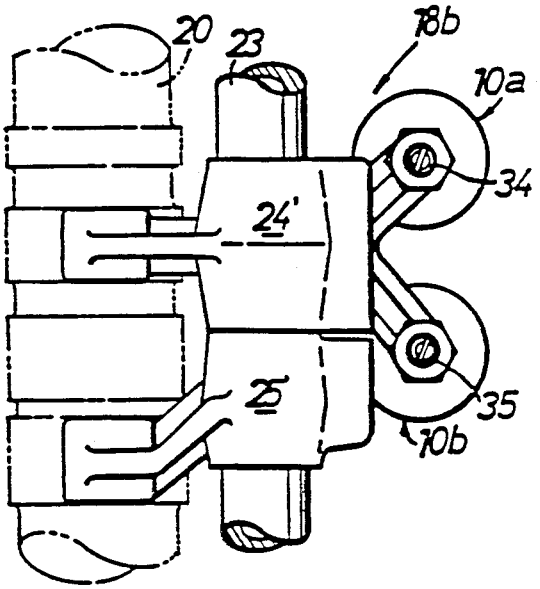
FIG. 11 is a partial plan view illustrating a fourth embodiment of the present invention.

FIG. 11 shows a fourth embodiment of the present invention. According to this embodiment the intake valve operating mechanism 18*b* has only two intake rocker arms 24', 25' similar to the previously described exhaust valve operating mechanism but both intake valves 10*a*, 10*b* are operatively coupled to one of the rocker arms 24'. In this embodiment, the number of cams and the number of rocker arms are reduced, thereby producing a valve operating arrangement of smaller size.

It will be appreciated that, by means of the hereindescribed invention, the intake and exhaust valve operating mechanisms are configured and arranged such that the intake and exhaust valves, whose operation they control, can be imparted with opening and closing movements that correspond precisely with the movements desired in the various operating modes of the engine.

Although certain preferred embodiments of the invention have been shown and described it should be understood that various changes can be made therein without departing from the scope of the appended claims.

I claim:

1. Valve operating means for controlling the operation of intake and exhaust valve means in an internal combustion engine, comprising:

camshaft means rotatable in synchronism with rotation of said engine;

a first set of cam followers operatively connected to said intake valve means;

a second set of cam followers operative connected to said exhaust valve means;

means for selectively connecting the cam followers of the respective sets for either independent or united operation;

a plurality of cams rotatably driven by said camshaft means including a first set of cams for operating said first set of cam followers and a second set of cams for operating said second set of cam followers under an operating mode different from that of said first cam followers;

said first set of cams being effective to operate the cam followers of said first set mutually identically under each respective condition of engine operation; and said second set of cams being effective to operate the cam followers of said second set mutually differently under one condition of engine operation and mutually identically under another condition of engine operation.

2. The valve operating means according to claim 1 in which said first set of cams includes first cams having corresponding cam profiles for operating said cam followers in said first set identically under one condition of engine operation when said first set of cam followers operate independently of one another and another cam having a cam profile different from that of said first cams for operating said cam followers in said first set identically when said first set of cam followers are united under another condition of engine operation.

3. The valve operating means according to claim 2 in which said first set of cam followers operate independently during low speed operation of said engine and in unison during high speed operation thereof.

4. The valve operating means according to claim 2 in which said second set of cams includes cams of different cam profiles and being operative to operate said second set of cam followers mutually differently under one condition of engine operation when said second set of cam followers operate independently of one another and identically according to the profile of one or said cams under another condition of engine operation when said second set of cam followers operate in unison.

5. The valve operating means according to claim 4 in which the cam followers in each of the respective sets operate independently during low speed operation of said engine and in unison during high speed operation of said engine.

6. Valve operating means for controlling the operation of a plurality of intake valves and a plurality of exhaust valves in an internal combustion engine, comprising:

camshaft means rotatable in synchronism with rotation of said engine;

a first set of cam followers operatively connected to said intake valves;

a second set of cam followers operatively connected to said exhaust valves;

means for selectively connecting the cam followers of the respective sets for either independent or united operation;

a plurality of cams rotatably driven by said camshaft means including a first set of cams for operating said first set of cam followers and a second set of cams for operating said second set of cam followers under an operating mode different from that of said first cam followers;

said first set of cams being effective to operate each of said intake valves mutually identically under each respective condition of engine operation; and said second set of cams being effective to operate each of said exhaust valves mutually differently under one condition of engine operation and mutually identically under another condition of engine operation.

7. The valve operating means according to claim 6 in which said first set of cams includes first cams having corresponding cam profiles for operating said intake valves identically under one condition of engine operation when said first set of cam followers operate independently of one another and another cam having a cam profile different from that of said first cams for operating said intake valves identically when said first set of cam followers are united under another condition of engine operation.

8. The valve operating means according to claim 7 in which said first set of cam followers operate independently during low speed operation of said engine and in unison during high speed operation thereof.

9. The valve operating means according to claim 7 in which said second set of cams includes cams of different cam profiles and being operative to operate said exhaust valves mutually differently under one condition of engine operation when said second set of cam followers operate independently of one another and identically according to the profile of one of said cams under another condition of engine operation when said second set of cam followers operate in unison.

10. The valve operating means according to claim 9 in which the cam followers in each of the respective sets operate independently during low speed operation of said engine and in unison during high speed operation of said engine.

11. The valve operating means according to claim 9 in which one of said cams of said second set is a circular raised portion operative to maintain the associated exhaust valve substantially closed.

12. The valve operating means according to claim 11 in which said one cam of said second set maintains the associated exhaust valve substantially closed during low speed operation of said engine.

* * * * *